United States Patent [19]

Harris

[11] 4,215,765

[45] Aug. 5, 1980

[54] ACOUSTICAL WALL BAFFLE AND METHOD OF MAKING

[75] Inventor: David A. Harris, Sylvania, Ohio

[73] Assignee: Owens-Corning Fiberglas Corporation, Toledo, Ohio

[21] Appl. No.: 973,308

[22] Filed: Dec. 26, 1978

[51] Int. Cl.[2] ..... E04B 1/343

[52] U.S. Cl. ..... 181/287; 181/290; 181/296; 52/144

[58] Field of Search ..... 181/210, 284, 286, 287, 181/290, 291, 295, 296, 292; 160/35, 135, 351; 49/409–411; 52/239, 765, 772, 582, 714, 238, 241, 243

[56] References Cited

U.S. PATENT DOCUMENTS

| | | | |
|---|---|---|---|
| 1,931,125 | 10/1933 | Balduj | 181/290 |
| 3,438,168 | 4/1969 | Tischuk | 52/714 |
| 3,553,915 | 1/1971 | Passovoy | 52/241 |
| 3,594,028 | 7/1971 | Scott | 52/582 |
| 3,608,258 | 9/1971 | Spratt | 52/241 |
| 3,777,435 | 12/1973 | Perina | 52/582 |
| 3,949,827 | 4/1976 | Witherspoon | 52/239 |
| 4,016,689 | 4/1977 | Wendt | 181/284 |
| 4,026,081 | 5/1977 | Delaney et al. | 52/145 |
| 4,034,463 | 7/1977 | Ryan | 52/239 |
| 4,057,123 | 11/1977 | Erickson | 181/286 |
| 4,084,367 | 4/1978 | Saylor et al. | 181/292 |

*Primary Examiner*—L. T. Hix
*Assistant Examiner*—Benjamin R. Fuller
*Attorney, Agent, or Firm*—Ronald C. Hudgens; Philip R. Cloutier; Paul J. Rose

[57] ABSTRACT

Two acoustical wall panels are secured together back-to-back to form an acoustical wall baffle installable perpendicularly to a wall of an office space in abutting relationship to the wall, ceiling, and floor. Each of the wall panels includes a fibrous glass board mounted in an extruded aluminum frame and covered on the front and edges with a decorative fabric. Each frame includes a rear mounting foot strip for spacing a wall panel from a wall and enabling the wall panel to be hung by the top frame member on concealed brackets, and a rear groove for anchoring the fabric covering by a rubber or plastic cord. The two wall panels are clipped together at the mounting foot strips of the frames by generally U-shaped metal or plastic strips. On the exposed vertical front edge of the wall baffle, a decorative trim strip is inserted between the two wall panels at the fabric anchoring grooves. The wall baffles are mounted by sliding them onto T-shaped mounting strips adhered to the ceiling and floor.

3 Claims, 3 Drawing Figures

ACOUSTICAL WALL BAFFLE AND METHOD OF MAKING

This invention relates generally to noise reduction or sound control in office spaces of commercial buildings, and more particularly to vertically extending acoustical wall baffles.

An object of the invention is to provide a method of constructing an acoustical wall baffle by constructing two wall panels of a special size for making the baffle therefrom and securing the wall panels together.

Another object is to provide an acoustical wall baffle made up of two panels constructed as though they were to be used as acoustical wall panels and then secured together back-to-back.

Other objects and advantages will become apparent when the following specification is considered along with the accompanying drawings in which.

Figure 1:
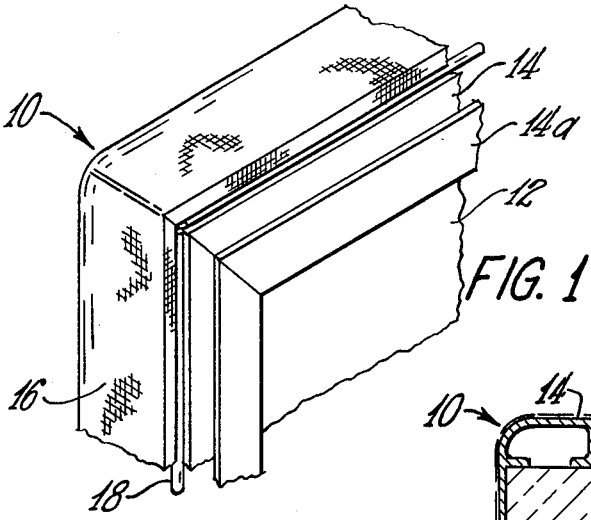
FIG. 1 is a perspective view of a rear corner portion of an acoustical wall panel of a type useful in the invention.

With respect to the drawings, an acoustical wall panel 10 is shown fragmentarily in FIG. 1. The panel 10 includes a fibrous glass board 12, an extruded aluminum frame 14 channelled to receive the board, a decorative fabric 16 covering the front of the board 12 and the front and edges of the frame 14, and a cord-like strip 18 of rubber or plastic anchoring the fabric 14 in a rear groove of the frame 16.

Figure 2:
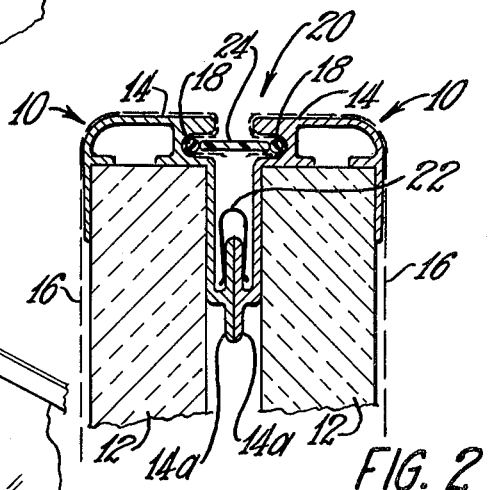
FIG. 2 is a fragmentary horizontal sectional view of a wall baffle constructed in accordance with the invention.
Figure 3:
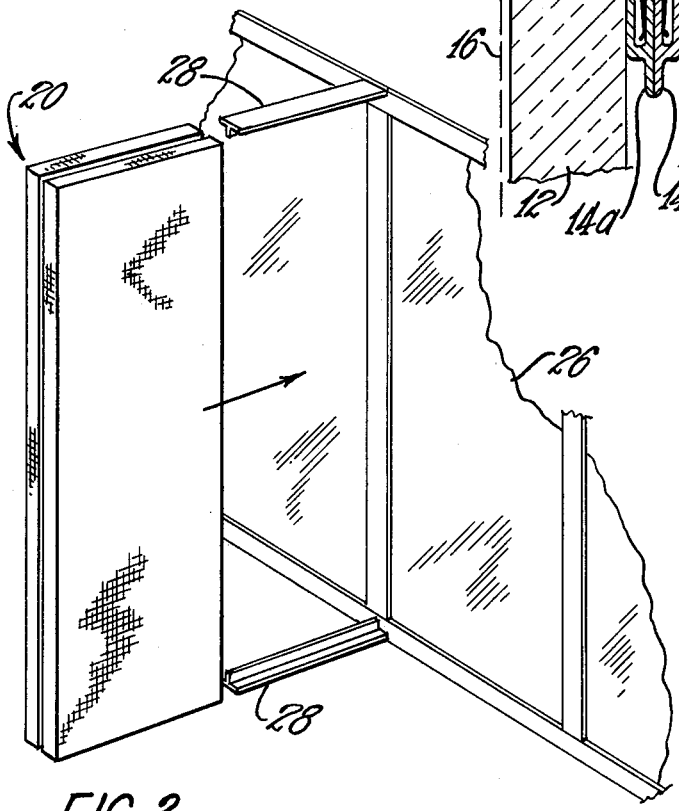
FIG. 3 is a perspective view of a window wall of a building showing a wall baffle constructed in accordance with the invention in the process of being mounted.

Two such wall panels 10 of an appropriate size are secured back-to-back as shown in FIG. 2 to provide a wall baffle 20 more fully shown in FIG. 3. The frame 14 of each wall panel 10 includes an integral mounting foot strip portion **14*a* which normally spaces the panel from a wall and enables the panel to be hung on wall brackets concealed by the panel and cooperable with the top frame member. The two wall panels 10 may be conveniently secured together by four generally U-shaped clamping strips 22 disposed respectively adjacent the top and bottom of opposed vertical edge portions of the wall baffle 20 and clamping the mounting foot strip portions 14*a* of the two wall panels 10 together. An exposed vertical front edge portion of the wall baffle 20 is preferably provided with a decorative trim strip 24 of contrasting color to the color of the fabric 16. Opposite edge portions of the trim strip 24 are disposed respectively in the fabric anchoring grooves of the wall panels 10**.

FIG. 3 fragmentarily shows a window wall portion 26 of a building. Generally T-shaped mounting strips 28 may be adhesively secured to the ceiling and floor (not shown) of a room. The wall baffle 20 may be slid onto the mounting strips 28 with the trunks of the T-shaped strips disposed between the two wall panels 10 of the wall baffle. When a room is provided with permanently installed cabinets (not shown) along an outer wall for housing heating and air conditioning equipment, the lower mounting strip 28 is adhesively secured to the top of a cabinet.

Various modifications may be made in the structure shown and described without departing from the spirit and scope of the invention as set forth in the following claims.

I claim:

1. A method of making an acoustical wall baffle, adapted to be mounted perpendicularly to a wall and to extend from the ceiling to the floor or to a floor cabinet, by clamping together the frame portions of two composite panels which would be used to hang the panels separately flatwise against a wall, the method comprising providing a pair of composite acoustical panels of appropriate size for the wall baffle, each panel being constructed in the same manner as an acoustical wall panel intended to be mounted flatwise against a wall and including a generally rectangular fibrous glass board, a frame surrounding the board and including four elongated frame portions, each frame portion having a channel in which a respective one of four edge portions of the board is received and including a generally T-shaped rear mounting foot strip portion integral with the channel, normally engageable with a wall, and enabling the panel to be hung flatwise against a wall on wall brackets concealed thereby, and a decorative fabric on a front side of the board, placing the panels together back-to-back with the rear mounting foot strip portion of each frame portion of one panel in abutting relationship with the rear mounting foot strip portion of a corresponding frame portion of the other panel, and clamping the abutting rear mounting foot strip portions together, by applying generally U-shaped clamping strips over the outer leg portions of the heads of the abutting T-shaped rear mounting foot strip portions on at least a pair of opposite frame portions of each of the frames, to secure the panels together back-to-back and thereby form said acoustical wall baffle.

2. An acoustical wall baffle adapted to be mounted perpendicularly to a wall and to extend from the ceiling to the floor or to a floor cabinet and formed of two composite panels clamped together by the frame portions thereof which would be used to hang the panels separately flatwise against a wall, the wall baffle comprising a pair of substantially identical composite acoustical panels each constructed in the same manner as acoustical wall panel intended to be mounted flatwise against a wall and including a generally rectangular fibrous glass board, a frame surrounding the board and including four elongated frame portions, each frame portion having a channel in which a respective one of four edge portions of the board is received and including a generally T-shaped rear mounting foot strip portion integral with the channel, normally engageable with a wall, and enabling the panel to be hung flatwise against a wall on wall brackets concealed thereby, and a decorative fabric on a front side of the board, and generally U-shaped clamping strips clamping the rear mounting foot strip portions of the frames of the two composite panels together with the rear mounting foot strip portion of each frame portion of one panel in abutting relationship with the rear mounting foot strip portion of a corresponding frame portion of the other panel, the U-shaped clamping strips being applied over the outer leg portions of the heads of the abutting T-shaped rear mounting foot strip portions on at least a pair of opposite frame portions of each of the frames.

3. An acoustical wall baffle as claimed in claim 2 wherein the frame of each of the composite panels has a rear groove for anchoring of the decorative fabric and an edge of the wall baffle intended to be an exposed vertical edge is provided with a trim strip disposed in the rear grooves of the frames.

* * * * *